United States Patent [19]

Deubler

[11] Patent Number: 4,993,152

[45] Date of Patent: Feb. 19, 1991

[54] DRY-SHAVING APPARATUS

[75] Inventor: Hans Deubler, Klagenfurt, Austria

[73] Assignee: U.S. Philips Corp., New York, N.Y.

[21] Appl. No.: 462,683

[22] Filed: Jan. 9, 1990

[30] Foreign Application Priority Data

Jan. 18, 1989 [AT] Austria ..... 87/89

[51] Int. Cl.[5] ..... B26B 19/02

[52] U.S. Cl. ..... 30/43.92; 30/346.51

[58] Field of Search ..... 30/34.1, 43, 43.91, 30/43.92, 346.51

[56] References Cited

U.S. PATENT DOCUMENTS 3,690,000 9/1972 Loner ..... 30/34.1
3,962,783 6/1976 Rentema ..... 30/43.92 X
4,233,733 11/1980 Gallanis et al. ..... 30/43.92

FOREIGN PATENT DOCUMENTS 1162719 8/1964 Fed. Rep. of Germany .
2028063 7/1971 Fed. Rep. of Germany .
2102968 9/1971 Fed. Rep. of Germany .

*Primary Examiner*—Douglas D. Watts
*Attorney, Agent, or Firm*—Ernestine C. Bartlett

[57] ABSTRACT

In a dry-shaving apparatus comprising a cutter (10) which is resiliently urged against an arcuate shear foil (5) and which is reciprocatingly drivable by a swing lever (17) which is pivotable about an axis (23) and which is offset relative to its plane of reciprocation (37), which cutter is connected to a drive member (24) so as to be pivotable about an axis (33) transverse to the plane of reciprocation (30) of the driving end (18) of the swing lever (17), which drive member is arranged on the driving end (18) of the swing lever (17) so as to be axially movable relative to said end and so as to be pivotable relative thereto, the axis (33) about which the cutter (10) is pivotably connected to the drive member (24) extends parallel to the axis (23) about which the offset swing lever (17) is pivotable.

4 Claims, 1 Drawing Sheet

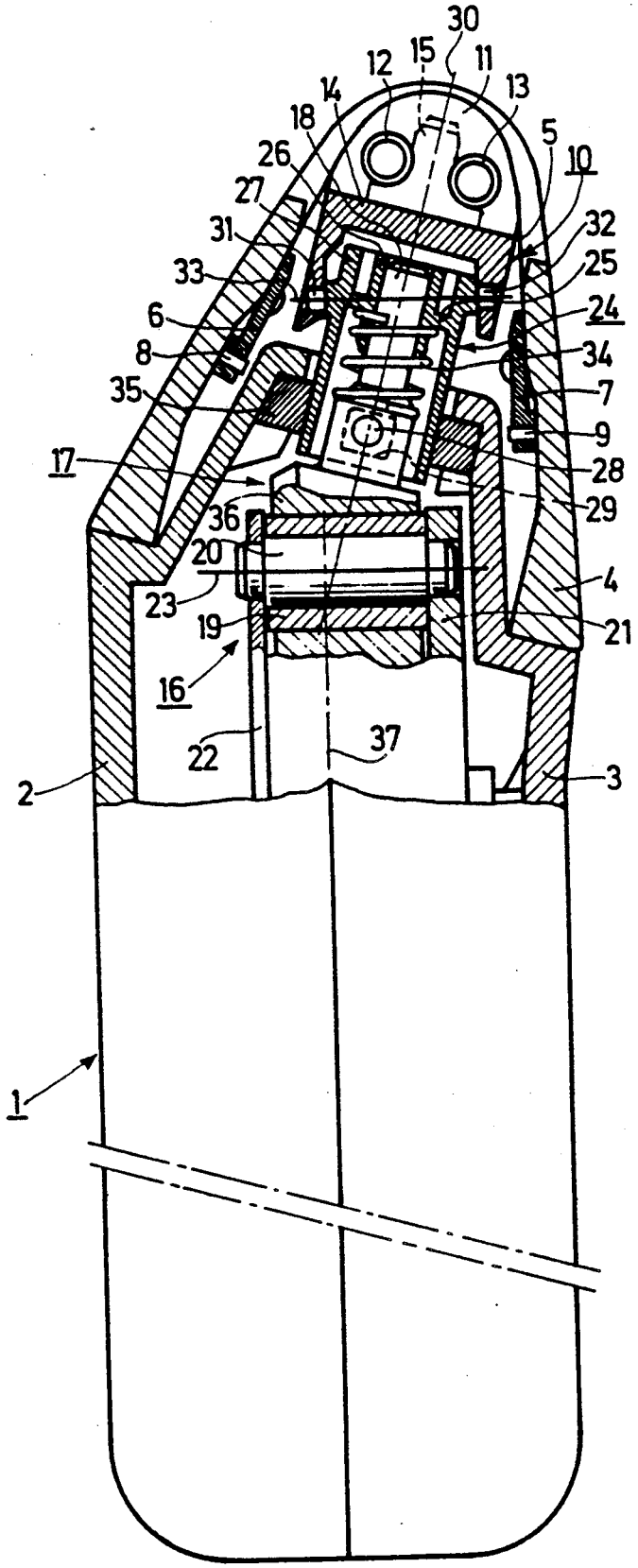
30
12
15
11
13
14
18
5
10
26
27
32
31
25
33
24
6
34
8
7
35
9
17
28
29
36
20
4
23
21
19
16
22
37
2
3
1

DRY-SHAVING APPARATUS

FIELD OF THE INVENTION

The invention relates to a dry-shaving apparatus comprising a cutter which is resiliently urged against an arcuate shear foil and which is reciprocatingly drivable by a swing lever which is pivotable about an axis and which is offset relative to its plane of reciprocation, which cutter is connected to a drive member so as to be pivotable about an axis transverse to the plane of reciprocation of the driving end of the swing lever, which drive member is arranged on the driving end of the swing lever so as to be axially movable relative to said end and so as to be pivotable relative thereto.

The embodiment disclosed in FIG. 7 of DE-OS 21 02 968 is an example of such a dry-shaving apparatus.

BACKGROUND OF THE INVENTION

In this prior-art shaving apparatus the drive member is formed by a ball having two diametrically opposed projections. A bore extends through the ball and the projections and is engaged by a drive pin having both ends connected to the cutter, so that the axis of the drive pin constitutes the axis about which the cutter is pivotable on the drive member, which axis extends perpendicularly to the driving end of the swing lever. Moreover, the ball is mounted in a bore formed in the driving end of a swing lever which is pivotable about an axis, its projections projecting from the driving end of the swing lever through slots adjoining the bore. The swing lever is offset relative to the plane in which it pivots to permit a laterally offset arrangement of a shaving-head frame carrying the shear foil, which is frequently desirable in order to make the dry-shaver easier to handle during shaving. As a result, the axes about which the swing lever and the cutter are pivotable on the drive member subtend an acute angle, which means that as it reciprocates the cutter tends to describe a path resembling a conical surface and thus inherently does not perform a rectilinear movement. However, since the drive member for the cutter is constructed as a ball, it can move relative to the driving end of the swing lever in accordance with all on the three possible degrees of movement, thereby allowing the drive member and the cutter connected to this member to be pivoted or tilted to all sides, so that as it cooperates with the shear foil the cutter is nevertheless guided rectilinearly by said foil. Thus a correct cooperation of the cutter with the shear foil is also guaranteed when the shear foil is subjected to a shaving pressure. Because of the three degrees of movement such an arrangement of the drive member at the driving end of the swing lever allows an omnilateral adaptation of the cutter to the shear foil; however, it is found that this does not yield a really satisfactory shaving performance of the dry-shaver under all circumstances. In particular, the shear foil is subjected to shaving pressure in a lateral direction transverse to the direction in which the cutter is reciprocated, which may lead to the cutter being canted inside the shear foil which defines its path. Moreover, since the cutter in principle tends to describe a path resembling a conical surface but is constrained to follow a rectilinear path by the shear foil, additional friction losses will arise between the shear foil and the cutter. This also gives rise to vibrations of the shear foil, inter alia resulting in more noise being produced.

SUMMARY OF THE INVENTION

An object of the invention is to eliminate the above problems and to provide a drive system for the cutter in a dry-shaving apparatus of the type defined in the opening paragraph, which provides a satisfactory shaving performance with a minimal noise production. According to the invention this is achieved in a construction wherein the spindle by which the cutter is pivotably connected to the drive member extends parallel to the axis about which the offset swing lever is pivotable. As a result even in the case of an offset swing lever, the cutter itself describes a path resembling a cylindrical surface throughout its reciprocatory movement, so that it can readily adapt itself to the arcuate shape of the shear foil without additional friction losses and noise production as a result of the rectilinear movement imposed by the shear foil. Therefore, because of the rectilinear movement, such a drive system for a cutter combines the required adaptation of the cutter to the shear foil and low friction losses with a satisfactory shaving performance of the dry-shaver. It also reduces wear between the cutter and the shear foil and the production of noise.

In this respect it is to be noted in particular that the invention relates exclusively to those dry-shaving apparatus which employ an offset swing lever. In a dry-shaving apparatus comprising a swing lever which is not offset relative to the plane in which it reciprocates, as is generally known, for example from DE-AS 1,162,719, the spindle by which the cutter is pivotably connected to the drive member inherently extends parallel to the axis about which the swing lever is pivotable. In such dry-shaving apparatus of this type the cutter performs a rectilinear reciprocatory movement without any additional measures being taken, so that a problem as caused by the use of an offset swing lever does not exist at all.

BRIEF DESCRIPTION OF THE DRAWING

An embodiment of the invention will now be described in more detail, by way of example, with reference to the accompanying drawing. The FIGURE of the drawing is a partly sectional side view of a dry-shaving apparatus comprising an offset swing lever for driving a cutter which cooperates with a shear foil.

DETAILED DESCRIPTION OF PREFERRED EMBODIMENTS

In the FIGURE the reference numeral 1 denotes a basic unit of a dry-shaving apparatus, which unit comprises two housing sections 2 and 3 on which a shaving-head frame 4 carrying an arcuate shear foil 5 can be placed. In order to secure the shear foil 5 to the shaving-head frame 4 the two longitudinal edges of the shear foil 5 are provided with strips 6 and 7 formed with holes which are engaged by pins 8 and 9 provided on the shaving-head frame 4.

A reciprocable cutter 10 cooperates with the shear foil 5 in a customary manner and is constructed as a lamellar cutter whose individual cutter lamellae 11, the arcuate shape of which to that of the shear foil 5, are arranged on two tubular spacers 12 and 13. This cutter 10 is arranged on a cutter support 14, for example in that the tubular spacers 12 and 13 are snapped onto two successive latching projections on the cutter support 14, which each carry two adjacent cutter lamellae.

For the reciprocating drive of the cutter 10 the basic unit 1 accommodates a drive system 16 comprising a pivotably supported swing lever 17 whose driving end 18 projects from the basic unit 1 in the direction of the cutter 10. This swing lever may form part of a vibrating-armature motor, not shown, of conventional construction, so that the swing lever is reciprocated directly. However, it is also possible to drive the swing lever 17 by means of, for example, an eccentric mounted on the shaft of a rotary electric motor. The swing lever 17 is pivotably supported by means of a bearing bush 19 by which it is mounted on a spindle 20 whose ends are supported in a mounting frame 21 and in a plate 22 which can be connected to the mounting frame 21, the mounting frame 21 being secured to, for example, the housing section 3 in a manner not shown. Thus, the swing lever 17 is pivotable about an axis 23 of the spindle 20, which axis is shown as a solid line.

Drive is transmitted from the driving end 18 of the swing lever 17 to the cutter support 14 by means of a drive member 24 arranged on the driving end 18 of the swing lever 17 so as to be movable in the axial direction of and pivotable relative to this end 18. In the present embodiment this drive member 24 comprises two coaxial hollow cylindrical portions 26 and 27 interconnected by a bridge 25, the portion 26 being constructed as a guide portion mounted on the cylindrical end 18 of the swing lever 17. At the location of the drive member 24 the swing lever 17 further comprises two diametrically opposed pin-shaped projections 28, which each engage in one of two diametrically opposed recesses formed in the portion 27 of the drive member 24. These recesses 29 form stops for the pins 28, thereby limiting both the axial movement and the pivotal movement of the drive member 24 on the free end 18 of the swing lever 17. The drive member 24 is connected to the cutter 14 by means of two diametrically opposed journals 31 and 32 provided on the portion 27 of the drive member 24, which journals extend transversely of the plane of reciprocation, represented by the broken line 30, of the driving end 18 of the swing lever 17 and which engage in correspondingly arranged bores in the cutter support 14. In this way the cutter support 14, and hence the cutter 10, is pivotably arranged on the drive member 24, the axis 33 defined by the journals 31 and 32 and shown as a solid line forming the pivotal axis for the cutter support 14. A pressure spring 34 is arranged between the drive member 24 and the swing lever 17, one of its ends acting against the drive member 24 and its other end acting against abutment surfaces provided on the swing lever 17, as is illustrated in the FIGURE. In this way the spring 34 urges the cutter 10 resiliently into the arcuate shear foil 5, so that the cutter lamellae 11 of the cutter 10 closely engage with the shear foil to assure a correct cooperation of the cutter 10 with the shear foil 5. Obviously, such a resilient engagement of the cutter 10 with the shear foil 5 can also be obtained in another manner, for example in known manner by employing two pressure springs instead one pressure spring 34, which springs each have one end acting on the cutter support 14 and another end acting on the housing section 2 or 3.

The described pivotable arrangement of the cutter support 14 on the drive member 24 and its axially movable and pivotable arrangement on the driving end 18 of the swing lever 17 enable the cutter 10 to adapt itself, in known manner, to the shear foil 5, so that also under the influence of a shaving pressure exerted on the shear foil during operation of the dry-shaving apparatus a correct cooperation of the cutter 10 with the shear foil 5 is guaranteed. It is to be noted that an elastic element 35 is arranged between the portion 27 of the drive member 24 and the housing sections 2 and 3 to seal the basic unit 1 in known manner against the ingress of shaving particles.

As is frequently desired, the shaving-head frame 4 carrying the shear foil 5 is laterally offset from the basic unit 1 of the present dry-shaving apparatus, as can be seen in the FIGURE, which makes the dry-shaver more convenient to handle during shaving. As a result of this, the swing lever 17 has an offset construction relative to the plane in which it reciprocates, in such a way that its driving end 18 is inclined relative to its portion 36 which is supported on the spindle 20, the plane in which the driving end 18 of the swing lever reciprocates and which is represented by the broken line 30 being inclined at an obtuse angle relative to the plane in which the portion 36 of the swing lever 17 reciprocates and which is represented by a broken line 37. In such a dry-shaving apparatus with an offset swing lever 17 the axis 33 about which the cutter support 14, and hence the cutter 10, is pivotable about the drive member 24 extends parallel to the axis 23 about which the swing lever 17 is pivotable. For this purpose, in contradistinction to the prior art, the journals 31 and 32 on the drive member 24 are not disposed perpendicularly but are inclined relative to the driving end 18 of the swing lever 17 in such a way that they extend parallel to the spindle 20 about which the swing lever 17 is pivotable. In this way even in the case of an offset swing lever 17, the cutter 10 driven by this lever basically describes a path resembling a cylindrical surface during its entire reciprocating movement and thus performs a rectilinear movement. This enables the cutter 10 to always adapt itself to the arcuate shape of the shear foil 5 without causing additional friction losses and noise, as is the case if the cutter 10 basically does not perform a rectilinear movement but such a movement is imposed on it by the shear foil 5.

Such a pivotable arrangement of the cutter on the drive member, as described above, thus enables the cutter to adapt itself to the shear foil owing to the rectilinear movement of the cutter and combines a satisfactory shaving performance of the dry-shaver with minimal friction losses, reduced wear between the cutter and the shear foil and less noise. This is achieved very simply without any additional means in that in the case of an offset swing lever, the axis about which the cutter is pivotable on the support and the axis about which the swing lever itself is pivotable extend parallel to one another.

Obviously, several modifications of the above embodiment are possible without departing from the scope of the invention, in particular with respect to the construction of the drive member, its arrangement on the driving end of the offset swing lever, and the manner in which the cutter is pivotably supported on the drive member, provided that the pivotal axis of the cutter extends parallel to the pivotal axis of the offset swing lever.

I claim:

1. A dry-shaving apparatus comprising a shaving head frame carrying an arcuate shear foil, a cutter which is resiliently urged against said arcuate shear foil and which is reciprocatingly drivable by a swing lever which is pivotable about an axis and which is offset relative to its plane of reciprocation, said cutter being connected to a drive member so as to be pivotable about an axis transverse to the plane of reciprocation of the driving end of the swing lever, the drive member being arranged on the driving end of the swing lever so as to be axially movable relative to said end and so as to be pivotable relative thereto, and wherein the axis about which the cutter is pivotably connected to the drive member extends parallel to the axis about which the offset swing lever is pivotable.

2. A dry-shaving apparatus as claimed in claim 1 in which the axis about which the cutter is pivotably connected to the drive member is defined by journals on the drive member which are inclined relative to the driving end of the swing lever.

3. A dry-shaving apparatus as claimed in claim 2 in which the axis about which the swing lever is pivotable is defined by a spindle the ends of which are supported in a mounting frame and in a plate connected to the mounting frame.

4. A dry-shaving apparatus comprising a shaving head frame (4) carrying an arcuate shear foil (5), a cutter (10) which is resiliently urged against said arcuate shear foil (5) and which is reciprocatingly drivable by a swing lever (17) which is pivotable about an axis (23) and which is offset relative to its plane of reciprocation (37), the cutter being connected to a drive member (24) so as to be pivotable about an axis (33) defined by journals (31) and (32) on the drive member (24), said axis (33) being transverse to the plane of reciprocation (30) of the driving end (18) of the swing lever (17), the drive member (24) being arranged on the driving end (18) of the swing lever (17) so as to be axially movable relative to said end and so as to be pivotable relative thereto, the axis (33) about which the cutter (10) is pivotably connected to the drive member (24) extending parallel to the axis (23) about which the offset swing lever (17) is pivotable.

* * * * *